United States Patent [19]

Goodwin et al.

[11] Patent Number: 4,733,609

[45] Date of Patent: Mar. 29, 1988

[54] LASER PROXIMITY SENSOR

[75] Inventors: Frank E. Goodwin, Burke; Michael S. Hersman, Fairfax; Anthony R. Slotwinski, Reston, all of Va.

[73] Assignee: Digital Signal Corporation, Springfield, Va.

[21] Appl. No.: 33,742

[22] Filed: Apr. 3, 1987

[51] Int. Cl.[4] ..... F42C 13/02; F41G 7/26

[52] U.S. Cl. ..... 102/213; 244/3.16; 356/5; 356/28

[58] Field of Search ..... 102/213; 244/3.16; 356/5, 27, 28

[56] References Cited

U.S. PATENT DOCUMENTS

| | | | |
|---|---|---|---|
| 3,644,042 | 2/1972 | Kolb, Jr. et al. | 356/5 |
| 3,733,129 | 5/1973 | Bridges | 356/5 |
| 3,901,597 | 8/1975 | White | 356/5 |
| 3,935,818 | 2/1976 | Johnson et al. | 102/213 |
| 3,937,575 | 2/1976 | Bateman | 356/5 |
| 4,309,946 | 1/1982 | Block | 102/213 |
| 4,505,582 | 3/1985 | Zuleeg et al. | 356/5 |
| 4,611,912 | 9/1986 | Falk et al. | 356/5 |

OTHER PUBLICATIONS

Linke, et al; "Coherent Optical Detection: A Thousand Calls on One Circuit"; IEEE Spectrum; Feb. 1987; pp. 52–57.

*Primary Examiner*—Charles T. Jordan

*Attorney, Agent, or Firm*—Cushman, Darby & Cushman

[57] ABSTRACT

A laser proximity sensor for a projectile includes a laser diode having front and rear facets. The diode generates a main laser signal and directs a first portion thereof out of the front facet as a source beam. Focusing means focuses the source beam on a target, and focuses the return beam reflected from the target into the laser diode through the front facet. The laser diode receives the return light beam, provides it with a positive gain, mixes it with the main laser signal, and guides it out the rear facet as a mixed beam. A detection focusing device focuses the mixed beam onto a PIN detector. The PIN detector coherently detects the mixed beam and provides an output signal having a perturbation where the target enters the focal field of the focusing optics. A processor detects the output signal from the PIN detector and may activate a fuse on the projectile. The processor is also capable of determining the relative velocity between the projectile and the target from measurement of the Doppler shifted signal or from the shape of the perturbation of the output signal from the PIN detector.

20 Claims, 7 Drawing Figures

DEPTH OF FOCUS FOR VARIOUS TARGETS WITH R=0.8m; D=2.76mm

LASER PROXIMITY SENSOR

BACKGROUND OF THE INVENTION

The present invention relates to a laser proximity sensor capable of detecting a distance to a target, and a relative velocity between the target and the sensor. More particularly, the present invention relates to a laser proximity sensor using a laser diode as the transmitter and as a receiver element for coherent optical detection of a laser beam reflected from a target. The present invention will be particularly useful for airborne munitions delivery systems, although persons of ordinary skill in this field will recognize many non-military applications, for example vehicle proximity sensors, laser velocity measurement systems, etc.

While the following application will be particularly directed to a laser proximity fuse for an airborne projectile, it is to be understood that the teachings of this invention are as broad as the appended claims.

Ideal proximity sensors (particularly munitions fusing devices) should share the same essential elements. Such sensors should be small in size (preferrably one cubic inch or smaller); have a minimum number of parts thus reducing complexity, lowering cost, and increasing reliability; have the capability of determining relative velocity between the sensor and a target; and have a wide operating system margin further increasing system robustness. Detection sensitivity must also be very high to ensure a rapid and precise indication of when the target reaches a given distance with respect to the sensor. Ideal sensors should also have a detection range from 0 to 10 meters with a very high resolution within that range. The sensor must be capable of mass production techniques.

Many known proximity detectors are extremely complex and unreliable. For example, infrared (IR) systems are passive sensors capable of being decoyed. In addition, such IR systems are only capable of guiding a projectile to the target for impact explosion and do not provide relative velocity measurement.

Television guidance systems are also known but are obviously not capable of being integrated into less than 1 cubic inch volume. In addition, television guidance systems are extremely unreliable and complex.

Pulsed radar systems are also used as proximity fusing devices. Again, such systems are large and less accurate than may be desired. In addition, the radar beam is a wide beam and thus incapable of careful target discrimination.

Pulsed laser proximity sensors are also known which include a transmit optical section and a receive optical section. The size, weight, and reliability of such systems make them inapplicable for mass production techniques and integration into smaller munitions. Furthermore, the detection sensitivity of such optical systems is very low, and subject to high false alarm rates.

Thus, there is a need for a compact, reliable, accurate, proximity sensor capable of mass production. The present invention proposes such a sensor.

SUMMARY OF THE INVENTION

The present invention provides a laser proximity device which overcomes the disadvantages of known proximity sensors.

The present invention includes a laser diode for generating a main laser signal and directing it from both the front and rear facets of the diode. A first focusing optics section focuses the laser signal emerging from the front facet onto a target. Light reflected from the target is then focused into the laser diode through the front facet. The laser diode thus acts as the transmitter and a receiver element in this system. The laser diode is a perfectly matched receiver which acts as a waveguide to mix the return light beam with the laser signal with perfect spatial mode matching. The mixed beam then emerges from the rear facet of the laser diode.

A second focusing section then focuses the mixed beam onto a PIN detector. Optical heterodyne detection of the mixed beam is then carried out in the detector and provides detection sensitivity approaching the quantum limit.

When the target enters the focal field of the first focusing optics section, the signal strength of the reflected light beam reaches a peak. By measuring the signal strength of the mixed beam at the detector, this peak may be readily detected. In a proximity fuse device, the focal length of the first focusing optics can be set at the desired proximity limit for munitions detonation. When the output signal from the detector reaches a peak, fusing of the munitions is activated.

The present invention is also capable of determining the relative velocity between the laser diode and the target. The first means of velocity determination is due to the Doppler shift of the signal heterodyning with the unshifted local oscillator thereby producing an rf pulse whose frequency is directly proportional to the velocity. A second means is determined by the sharpness of the pulse envelop which is also proportional to the target velocity. Where relative velocity is high, the signal peak from the detector will be relatively sharp. This peak can be integrated to ascertain the relative velocity.

If desired, a scanning section can be optically coupled between the first focusing section and the target. The scanning apparatus allows the laser beam to be scanned to locate the target. Then, the beam is commanded to dwell upon the target while the vehicle is steered thereto. Then, fusing is activated whenever the fusing distance is reached.

BRIEF DESCRIPTION OF THE DRAWINGS

The structure and functions according to the present invention will be more readily understood from the following detailed description of the presently preferred exemplary embodiment, when taken together with the attached drawings which show.

DETAILED DESCRIPTION OF THE PRESENTLY PREFERRED EMBODIMENT

Figure 1:
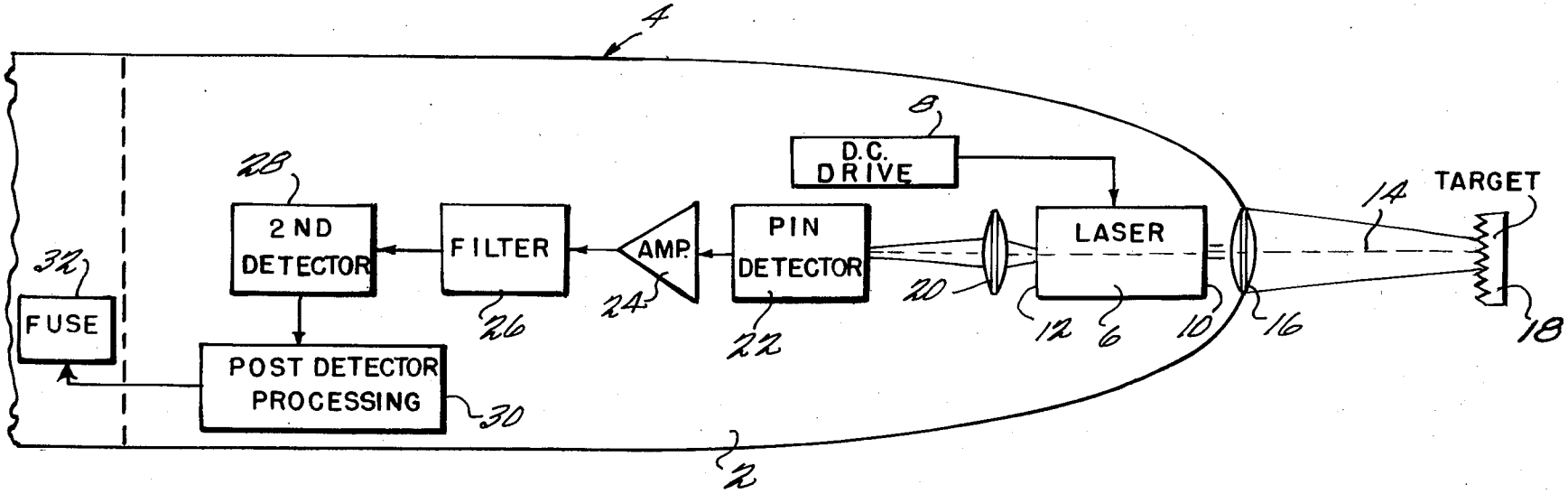
FIG. 1 is a schematic diagram of the present invention incorporated into an airborne projectile.

The present invention proposes to utilize the laser diode as the transmitter and a receiver element for perfectly matching the spatial mode of the return beam and the main laser signal. Phase matching of the two beams occurs in the laser cavity and they are coherently detected at the detector. Optical coherent detection (optical heterodyning) is capable of providing over 1,000-fold increase in the sensitivity of the return signal. The present invention utilizes this concept in a unique, compact device for proximity and velocity sensing.

Recently, advances in optical technology have enabled the use of coherent (heterodyne) optical detection techniques. The techniques and advantages of optical detection are generally described in the co-pending U.S. application Ser. No. 590,350 entitled "FREQUENCY MODULATED LASER RADAR", the teachings of which are incorporated herein by reference. Additionally, the article entitled "COHERENT OPTICAL DETECTION; A THOUSAND CALLS ON ONE CIRCUIT" by Link and Henry, IEEE Spectrum, February 1987, pp. 52–57 describes the present state of optical heterodyne reception. The teachings of this article are also incorporated into this application by reference.

The advantages of coherent optical detection are fundamental. The information-carrying capacity of the optical beam reflected from the target is orders of magnitude greater than available systems. The use of optical heterodyne detection allows for optical radiation detection at the quantum noise level. As such, coherent optical systems provide greater range, accuracy, and reliability than many known prior art telemetry and ranging systems. Such coherent systems yield measurements that are unique and unambiguous. In addition, the heightened sensitivity of the detected signal allows rough surfaces and diffuse targets to be detected and tracked. Coherent optical systems also can provide a greater range, a greater working depth of field, and may also operate in ambient light conditions with non-reflective targets.

Briefly, optical heterodyne detection provides a source light beam which is directed to a target and reflected therefrom. The reflected light beam is then mixed with a local oscillator light beam on a photodetector to provide optical interference patterns which may be processed to provide detailed information about the target, such as range and relative velocity. Optical heterodyne techniques take advantage of the source and reflected light beam reciprocity. For example, these light beams are substantially the same wavelength and are directed over the same optical axis. This provides an improved signal-to-noise ratio (SNR) and heightened sensitivity. The available SNR is sufficiently high so that a small receiving aperture may be used, in contrast to known large-aperture optical systems. Since a smaller receiver aperture can still provide detailed information about the target, the focusing optics of such systems may be made very small and compact. For example, a coherent optical system using a TM inch aperture can provide more information about a target than a 4 inch aperture used with a direct optical detection system.

Key technologies of AlGaAs laser diodes and fiber optical components are enjoying a burst of development for applications in telecommunications. Because of these efforts, recent improvements in the quality of injection laser diodes provide the coherence length and wavelength tuning range needed for a precision proximity sensing device. The small size of the injection laser diode and high-technology integrated optical assemblies make possible the development of a new family of small, low cost, proximity sensors which are orders of magnitude more accurate and more reliable than their conventional counterparts.

One coherent optical detection system is described in U.S. Pat. No. 4,611,912 to Falk et al. Falk et al '912 describes a method and apparatus for optically measuring a distance to and velocity of a target. In Falk et al, a laser diode provides a linearly polarized, amplitude modulated (with frequency modulated sub-carrier) source light beam. The source light beam is directed to a polarization-dependent beam splitter which reflects it toward a target. Between the beam splitter and the target is disposed a quarter-wave retardation plate which converts the linearly polarized source light beam into right-hand circularly polarized optical radiation. Between the quarter-wave plate and the target, a local oscillator reflector plate reflects approximately 1% of the source light beam back toward the beam splitter, while allowing approximately 99% of the source light beam to pass toward the target. Light reflected from the target and the local oscillator beam are thereby converted from right-hand circularly polarized optical radiation to left-hand circularly polarized optical radiation. These beams then pass back through the quarter-wave plate and are thereby converted to linearly polarized light beams. These linearly polarized light beams pass through the polarizing beam splitter and are concentrated on a PIN diode by a collecting optical lens. Thus, the local oscillator and the return beam are both linearly polarized in the same direction and are directed along the same optical axis. Thus, the PIN diode detects an optically mixed signal containing the local oscillator beam and the light beam reflected from the target.

However, an extreme disadvantage of Falk et al '912 is that very close alignment is required between the optical components. The laser diode, the beam splitter, the quarter-wave plate, the PIN diode, and especially the local oscillator reflecting plate must be carefully adjusted before usable signals may be obtained. Such close adjustment allows for rapid system degradation and rules out this apparatus for use in mass production techniques. In addition, temperature changes and mechanical shocks (particularly seen in the munitions delivery field) will destroy the effectiveness of the apparatus of Falk et al '912.

Another known laser system for monitoring the motion of an object is disclosed in U.S. Pat. No. 3,644,042 to Kolb, Jr. et al. In Kolb, Jr., a laser beam is generated from laser 10 and directed toward a moving object 14. That portion of the laser beam reflected from object 14 is directed back into laser 10 causing the laser to produce output 15 laser energy which varies in intensity according to the motion of the object. Note that no optical heterodyning occurs in the laser cavity of Kolb Jr. When the laser energy is reflected back into the laser 10, the effective reflectivity of the laser optical cavity is altered in accordance with the phase of the return laser beam. Thus, the returned energy will be in phase with the emitted energy. The distance to the moving target is determined by the number of maxima and minima in the intensity of the laser oscillation. The altered laser beam is then directed from the rear face of the helium-neon laser to an energy transducer for detection of the maxima and minima.

Since, the Kolb system does not utilize coherent detection it provides 1,000-fold less sensitive signal then the present invention. The detection mechanism of Kolb is due to the fact that the helium-neon (gas) laser competes to lase on two wavelengths simultaneously, 633 nm and 3390 nm. The sensor must always be on the threshold of laser action at 3390 nm in order to function properly. The laser lases against the target at 3390 nm and lases against the output mirror at 633 nm. The output mirror must be partially transparent to the 3390 nm wavelength. When the target moves toward or away from the laser, a 3390 nm laser threshold occurs and a quenching effect is produced at the 633 nm wavelength. The detector is chosen to be sensitive only at 633 nm and modulations of the shorter wavelength 633 nm intensity occur for every 3390/2nm change in the target position.

Therefore, the sensitivity of the Kolb scheme is limited to a very narrow range of signal levels at which the 3390 nm wavelength produces the quenching effect. Thus, a partially cooperative target is required. The system does not operate against weak diffuse targets. In addition, the Kolb apparatus is certainly not suited to a proximity fusing device because it is very large, complex, has poor detection sensitivity, is not robust, and has virtually no operating system margin.

U.S. Pat. No. 4,505,582 to Zuleeg et al describes a self-detecting optical sensor. This is a pulsed laser system and thus must have a very wide detection bandwidth in order to achieve range resolution. In contrast, the present invention proposes to use a continuous wave laser. For example, a resolution of one foot requires a bandwidth of one gigahertz. In the Zuleeg concept, the laser itself acts as a detector, and partial coherent optical detection is claimed due to a residue of the laser light after the transmitting pulse acting as a local oscillator. However, the minimum range is limited by the deadtime (pulse recovery time) to about two or three meters, and the maximum range is limited by the residual tail of the laser local oscillator light. Zuleeg claims a 10 to 20 dB improvement detection sensitivity over direct detection. However, the use of the laser itself as a detector may not be anywhere near ideal. Thus, the "improvement" over direct detection may be an improvement over a very poor sensitivity. Overall, the useful operating range of Zuleeg appears to be 3 to 5 meters, making it unusable for many ammunition proximity fusing applications. Furthermore, the laser itself is a special device developed specifically for the dual laser-detect modes of operation. This degrades the performance of either the laser or the detector operation.

Furthermore, the Zuleeg apparatus is excluded from consideration as a proximity fuse because it has no velocity discrimination capability, its quantum limited detection sensitivity is limited to ranges of more than 2–3 meters and less than 5 meters, its detection range is limited to the range of 3 to 5 meters, and it has practically no system margin.

A laser distance measuring device is also disclosed in U.S. Pat. No. 3,901,597 to White. White discloses a laser distance measuring device in which the laser beam reflected from the target is injected into the laser to cause oscillation thereof. Note that optical system 16 and 17 is designed to provide a focal saddle at a given range. When the target is within the focal saddle, the laser energy reflected from the target and injected into the laser will cause the laser to oscillate, providing an output signal. Note also that White does not disclose coherent optical detection.

Furthermore, the White system is similar to Kolb in that it is a laser threshold device which does not use coherent detection. However, unlike Kolb, this is a single wavelength device. Therefore, the detector registers a current when the laser is on, and no current when the laser is off. Lasing action occurs only when the target surface lies in the focal saddle. Similar to Kolb, modulations of laser amplitude occur for every half wavelength movement of the target. This is achieved by making the laser a dual polarization device where the two polarizations compete, and each dominates the other for every quarter-wavelength shift in target position. The technique has the same detection sensitivity (low) as the Kolb device.

The White apparatus can also be excluded from consideration as a proximity fuse sensor because it is also large and complex, it has a very poor detection sensitivity, it is not robust, and it has virtually no system operating margin.

Electro-optical sensor means are also disclosed in U.S. Pat. No. 3,937,575 to Bateman. Bateman discloses electro-optical ranging means having an optical lens system 12 which is used to receive energy reflected from the target and injected back into the laser diode 10. Laser diode 10 becomes conductive upon the receipt of its own returned energy and thus provides a ranging signal. The ranging signal is used to determine the distance between the laser diode and the target. Note also that Bateman does not disclose coherent optical detection.

Furthermore, like Zuleeg, Bateman is a pulsed laser system and thus must have a very wide detection bandwidth in order to achieve the required range resolution. For example, a resolution of one foot requires a detection bandwidth of $10^9$ HZ. Also like Zuleeg, the laser itself is used as a detector. However, unlike Zuleeg, Bateman uses only direct optical detection. Again, the minimum range is limited by the deadtime (pulse recovery time) to about 2 to 3 meters. The maximum range is limited by the direct detection sensitivity to less than 5 meters.

Bateman also may be excluded from consideration as a proximity fuse detector because it has no velocity discrimination capability, it has poor detection sensitivity, its detection range is limited to 3 to 5 meters, and it has very little operating system margin.

In summary, all prior art proximity detectors known to the inventors have been excluded from application as an ideal proximity fuse sensor. The main advantages of the present invention over these known devices is simplicity and near ideal quantum limited detection sensitivity due to the coherent optical detection and the use of the laser diode cavity as the transmitter and receiver to mix the beams. Although Zuleeg claims to be achieving coherent detection, it is far from quantum-limited. Furthermore, the Zuleeg system is a pulsed system and therefore requires a very large detection bandwidth. It may be instructive to compare critical parameters of the two systems:

| Quantity | Zuleeg | Present Invention |
|---|---|---|
| Available Signal Power | 10 W | 0.1 W |
| NEP, W-Hz$^{-1}$ | $>10^{-17}$ | $10^{-19}$ |
| Detection Bandwidth. Hz | $10^9$ | $<10^6$ |

-continued

| Quantity | Zuleeg | Present Invention |
|---|---|---|
| Available SNR | $10^9$ | $10^{12}$ |
| Net Advantage of Present Invention | | $>10^3$ |

The net advantage of $10^3$ of the present invention over the closest prior art example is achievable because both the source and detector may be optimized functionally. Using the transmitter also as a receiver results in efficient use of both. Finally, although the present invention is deceptively simple, the reasons for excellent performance are extremely subtle and elegant.

Furthermore, the structure of the present invention is different from the prior art in that no prior art system uses the laser cavity as a waveguide to direct the signal to the detector for the purpose of achieving coherent detection.

The laser proximity sensor according to the present invention achieves quantum-limited detection sensitivity. The laser source defines a single spatial mode which serves to illuminate the target by part of the light transmitted out of the front facet of the diode being transmitted through the focusing lens and impinging on the target, and which serves to illuminate the detector with a local oscillator beam by the remainder of the light emerging from the back facet of the laser source and impinging on the detector. The light scattered back from the diffuse target is scattered over a hemisphere and a portion is collected by the focusing lens and is focused on the front facet of the laser and is passed through the laser cavity with positive gain and finally is passed through the detector focusing lens and impinges on the PIN detector. The signal energy is perfectly phase matched with the source and with the local oscillator, thereby producing perfect mixing (interference) on the detector. The results are ideal coherent detection where sensitivity approaches the quantum limit.

At the quantum limit, the minimum detectable power $P_{min}$ is derived as follows:

$$P_{min}=h\nu B/\eta \quad (1)$$

where h is Planck's constant, $\nu$ is the optical frequency, B is the electrical bandwidth, and $\eta$ is the detector quantum efficiency.

When the laser source is frequency modulated at a rate $d\nu/dt$, the distance R from the source to the target is calculated as follows:

$$R=c(f_s)/2(d\nu/dt) \quad (2)$$

where $f_s$ is the frequency of the detected signal.

When the laser source is continuous wave (CW-fixed frequency), the velocity of the target can be determined from the signal Doppler shift such that the velocity v is given by:

$$v=(\lambda/2)f_s \quad (3)$$

where $\lambda$ is the wavelength.

The advantages of reduced complexity and quantum-limited detection sensitivity makes the present invention an ideal choice for many laser proximity detection applications.

Briefly, the laser proximity sensor depicted in FIG. 1 focuses the light returned from the target back into the laser facet and into the laser cavity. The returned signal is transmitted through the laser diode and emerges from the back facet in alignment with the main laser signal to a detector where it is coherently detected using the main laser signal as the local oscillator. Relative motion between the sensor and the target creates a Doppler offset in the return signal which appears as an RF signal at the detector output. As the target passes through the focal distance of the optical system, a sharp peak in detected RF signal strength may be used as the fuse trigger point.

In more detail, FIG. 1 shows the present invention mounted in the nose 2 of an airborne vehicle 4. A laser diode 6 is driven by DC drive 8 to produce a continuous wave main laser signal.

Laser diode 6 may be any known laser diode device such as the Hitachi HLP-1400, or the SHARP LT015. Those having skill in this field understand that rapid advances are being made in laser diodes. It is believed that the advantages accruing to the present invention will be enhanced with future advances in the art of laser diodes.

Laser diode 6 generates a main laser signal which emerges from laser front facet 10 and laser rear facet 12. Generally, the laser beams emerge along optical axis 14.

Focusing optics 16 may be fitted to the tip of nose 2, or any other convenient location on the projectile. Focusing optics 16 receives the main laser signal emerging from front facet 10 and focuses it on target 18.

Light reflected from target 18 is received by focusing optics 16 and re-focused into laser diode 6, preferrably at front facet 10.

The laser cavity of laser diode 6 now acts as a waveguide to direct the return light beam along optical axis 14 to emerge from rear facet 12 of laser diode 6. In the laser cavity, the return light beam is provided with a positive gain (greater than unity gain) and mixed with the main laser signal. Note that perfect spatial mode matching occurs between the main laser signal and the return light beam. In fact, the laser cavity of laser diode 6 is a perfectly matched receiver element for the return signal. The wavelength passband of the laser cavity is necessarily the same as the wavelength of the return beam. For example, the passband of laser diode 6 is many GHz, while the main laser signal (and the Doppler-shifted return light beam) may be centered around 800 MHz. Thus, by utilizing the laser cavity of laser diode 6 as the mixing chamber for the main laser signal and the return light beam, perfect spatial mode matching is achieved.

The mixed light beam is then directed from rear facet 12 of laser diode 6 to detection optics 20. Detection optics 20 focuses the mixed beam on photodetector 22.

Photodetector 22 is preferably a PIN detector used because of its heightened sensitivity. However, those of skill in this field will understand that existing and future photodetectors may be advantageously employed in the present invention. For example, photodetector 22 may comprise a photoconductor, a PN photodetector, and avalanche photodetector, photomultipliers, a resonant optical cavity detector, pyroelectrical detectors, and other known and future means for detecting a light beam. All such usable photodetectors are to be included within the spirit of the appended claims.

Photodetector 22 thus provides a pulsed signal at the wavelength of the return light beam, for example 800 MHz. Amplifier 24 may be employed to amplify this signal and pass it on to filter 26. Filter 26 is a passband filter whose characteristics may depend upon use. For example, where the relative velocity between projectile 4 and target 18 is approximately MACH 1, the Doppler shift may be 800 MHz. Thus, the passband of filter 22 may be set at 700–900 MHz.

The filtered signal is than passed to second detector 28 where the RF pulse envelope is used to derive a DC pulse provided to post detection processing device 30. Post detection processor 30 may be advantageously used to determine when the target 18 enters the focal detection range of focusing optics 16. In addition, post detection processing device 30 may be used to determine the relative velocity between projectile 4 and target 18 from the signal provided by detector 28.

Therefore, post detection processing unit 30 may provide a fusing signal to fuse device 32 to activate detonation of munitions carried aboard projectile 4.

Figure 2:
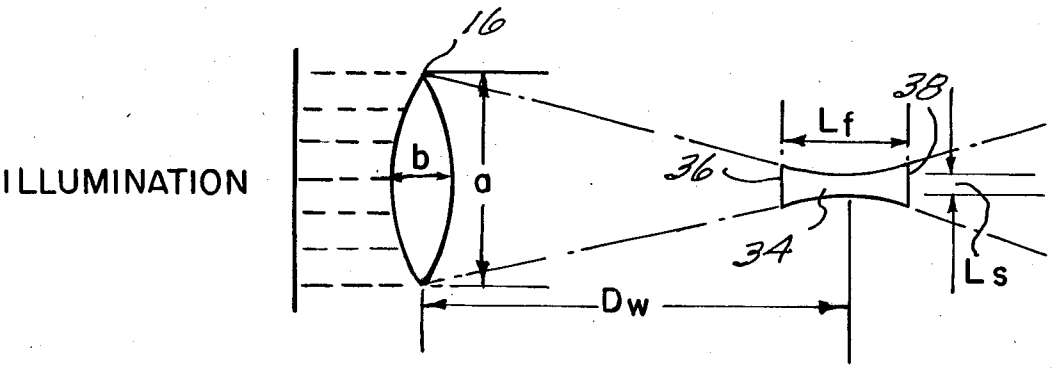
FIG. 2 is a schematic diagram showing the focal length of the first focusing optics section.

FIG. 2 depicts the focusing field of focusing optics 16. Different optical devices may be used to vary the focusing field, again depending on use. Basically, focusing optics 16 (which may be a single lens or a plurality of lenses, even movable lenses) has a diameter a and width b whose dimensions determine the shape of the focusing field.

FIG. 2 depicts a focus saddle 34 centered on the focal length $D_W$ of focusing optics 16. Focusing saddle 34 has a focus length $L_f$. Of course, the focus length $L_f$ may be varied depending upon the optical system used and the application for which the sensor is designed. The output signal from detector 22 will increase as the target enters the focus saddle 34. When the target is at the exact center of focusing saddle 34 (at the exact focal length $D_W$), the output signal from detector 22 will peak. Then, the signal strength will decline as the target moves from the focal length $D_W$ toward focusing optics 16. These dynamics are clearly depicted in FIG. 3.

Figure 3:
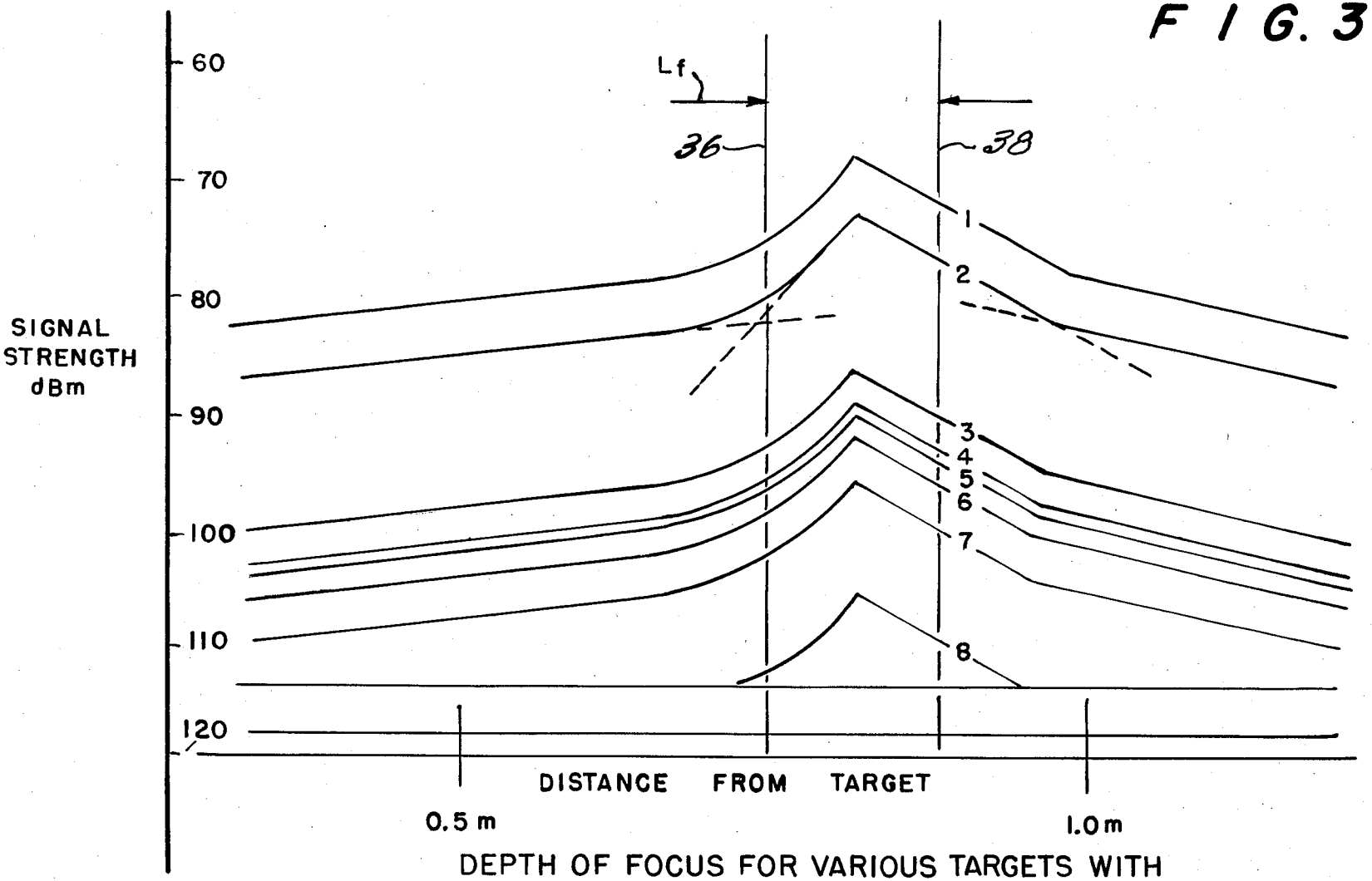
FIG. 3 is a signal diagram showing the signal strength of the detector versus distance from the target.

FIG. 3 is a signal chart showing the depth of focus for various targets utilizing the apparatus according to the present invention. These are actual experimental results.

In FIG. 3, the depth of focus R and the depth of range d were set respectively at 0.5 m and 2.52 nm. The two vertical lines 36 and 38 mark the theoretical depth of focus (see FIG. 2). In each instance, the target was brought close to the laser proximity sensor and the signal output from post detection processing device 30 was plotted. Target No. 1 was red Scotchlite (Tm). Target No. 2 was black Anodizied Aluminum. Target No. 3 was white paper. Target No. 4 was Graphite-Composite-Greenside. Target No. 5 was Teflon (Tm). Target No. 6 was Graphite-Composite-Blackside. Target No. 7 was human skin. And, Target No. 8 was a 1% reflectivity target. It is important to note that even with the low reflectivity target, a signal peak is discernable. This means that a proximity detector according to the present invention can work against extremely weak diffuse targets, an objective of all proximity sensors. In each case, a discernable peak is found. Such a signal perturbation is easily used as the trigger point to detonate the munitions aboard projectile 4.

Theoretically, the SNR should drop 3dB between the center of focus and vertical lines 36 and 38. The experimental data shows a 2.9 dB drop on the near side (vertical line 38), and a 3.8 dB drop on the far side (vertical line 36). These values are well within the experimental error of theory when target specularity is considered. This provides a basis for using classical optics theory to predict the performance of the laser proximity sensor. The useful depth of range is much larger than this value. The target can be seen until the SNR drops below the receiver detection threshold which is expected to be nominally 10 dB above the shot noise. The brighter the target, the larger the operational depth of range. Of course, various range/optical aperture combinations can provide different shaped signal peaks. Thus, optimum range and optimum combinations may be provided depending upon the use for which the particular projectile is intended.

Figure 4:
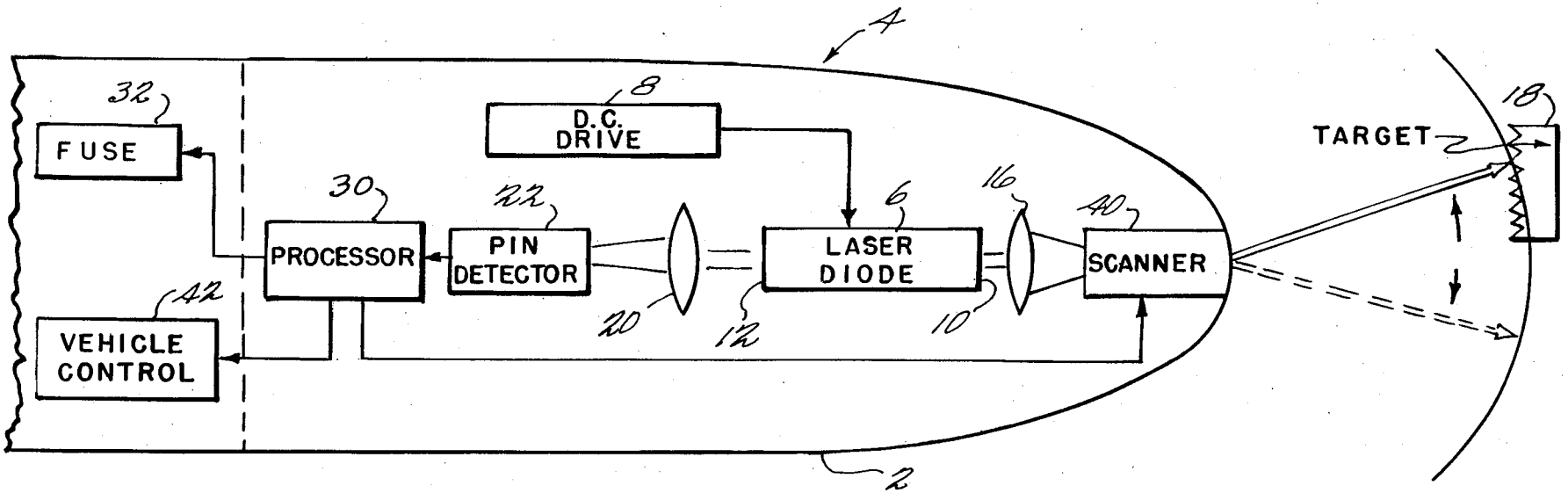
FIG. 4 is an embodiment of the present invention utilizing a scanning section to locate the target.

FIG. 4 is an alternative embodiment of the present invention. In FIG. 4, a scanning section 40 is optically coupled in the nose 2 of the projectile 4. Scanner 40 takes the focused light beam and scans it across a particular volume to search for the target. This embodiment may be particularly useful as a homing/proximity fused device. As improvments in injection laser diodes are realized, the coherence length thereof will increase, making a homing device practicable.

In the embodiment of FIG. 4, processor 30 commands the scanner to scan in any convenient scan pattern. For example, a raster scan may be employed. Once the beam has struck the target, the return light beam will be detected by detector 22 and transmitted to processor 30 (through amplifier 24, filter 26, and second detector 28, not shown). Processor 30 will then command scanner 40 to maintain the laser beam on target 18. Then, processor 30 may provide command signals to vehicle control section 42 which may control the vehicle navigation to direct it toward target 18. Then, scanner 40, processor 30, and vehicle control section 42 cooperate to align the laser beam on the target and home the vehicle towards it. When the vehicle reaches the appropriate proximity point, fusing section 32 will detonate the munitions.

Scanner 40 may include any known or convenient scanning apparatus. For example, scanning should be extremely rapid to ensure adequate target search for the rapidly moving projectile. For example, using a facet wheel combined with a galvanometer may provide rapid scanning for use with the present invention. For example, the facet wheel may be used to scan in the vertical direction, while the galvanometer is used to scan in the horizontal direction. However, persons of skill in this field will understand that a wide variety of mechanical and electronic scanning devices may be used to scan the laser beam in search of the target. For example, holographic scanners may be used since the present invention encompasses single mode lasers. In general, many scanning methodologies may be used, for example, a fast scan, a slow scan, a raster scan, a serpentine scan, etc. Generally, scanning technology is well known and will not be described further herein.

Now, the performance of the coherent laser proximity sensor will be quantized. Performance of the coherent laser proximity sensor can be characterized by SNR vs. range and depth of range. Maximum radar range is defined from classical radar analysis. The target is assumed always to be extended or larger than the beam spot size. The SNR then varies as the inverse square of the range rather than as the fourth power as with conventional microwave radars. If the SNR is defined as some threshold value required for detection, then the maximum range $R_{max}$ is determined to be $$R_{max} = \left(\frac{P}{N_o}\ \frac{\rho}{\pi}\ \frac{\tau}{\sigma}\right)^{\frac{1}{2}} d \tag{4}$$

where

P is the average radiated laser transmiter power $\tau$ is the pulse length d is the beam diameter $\sigma$ is the the treshold SNR $\rho$ is the target reflectivity $N_o$ is the optical hereodyne NEP spectral density.

The depth of focus of the laser radar can be calculated from classical optics to be:

$$\Delta R = 2\left(\frac{R_f}{d}\right)^2 \lambda, \tag{5}$$

where $\Delta R$=depth of focus $R_f$=range at center of focus d=beam diameter at radar aperture $\lambda$=wavelength of laser The ratio $R_f/d$ is known as the focal ration or speed of the optical system. However, for a coherent laser radar, the ratio $R_f/d$ is:

$$R_f/d = \left(\frac{P}{N_o}\ \frac{\rho}{\sigma}\ \frac{\tau}{\pi}\right)^{\frac{1}{2}} \tag{6}$$

Substitution in the depth of focus equation above gives the depth of range of the laser radar, $$\text{Depth of Range} = \left(\frac{P}{N_o}\ \frac{\rho}{\sigma}\ \frac{\tau}{\pi}\right) 2\lambda \tag{7}$$

Interpretation of the depth of range expression is that detection of a target within the spatial mode (focal saddle) bounded by $\Delta R$ and beam diameter d requires a specific minimum power to noise ratio and target reflectivity.

Verification of the radar range performance is best achieved by measuring SNR $\sigma$ as a function of range for a target of known reflectivity and comparing the experimental values with theory. Solving for SNR as a function of range gives $$\sigma = SNR = \frac{P}{N_o}\ \frac{\rho}{\pi}\ \tau\left(\frac{d}{R}\right)^2 \tag{8}$$

Figure 5:
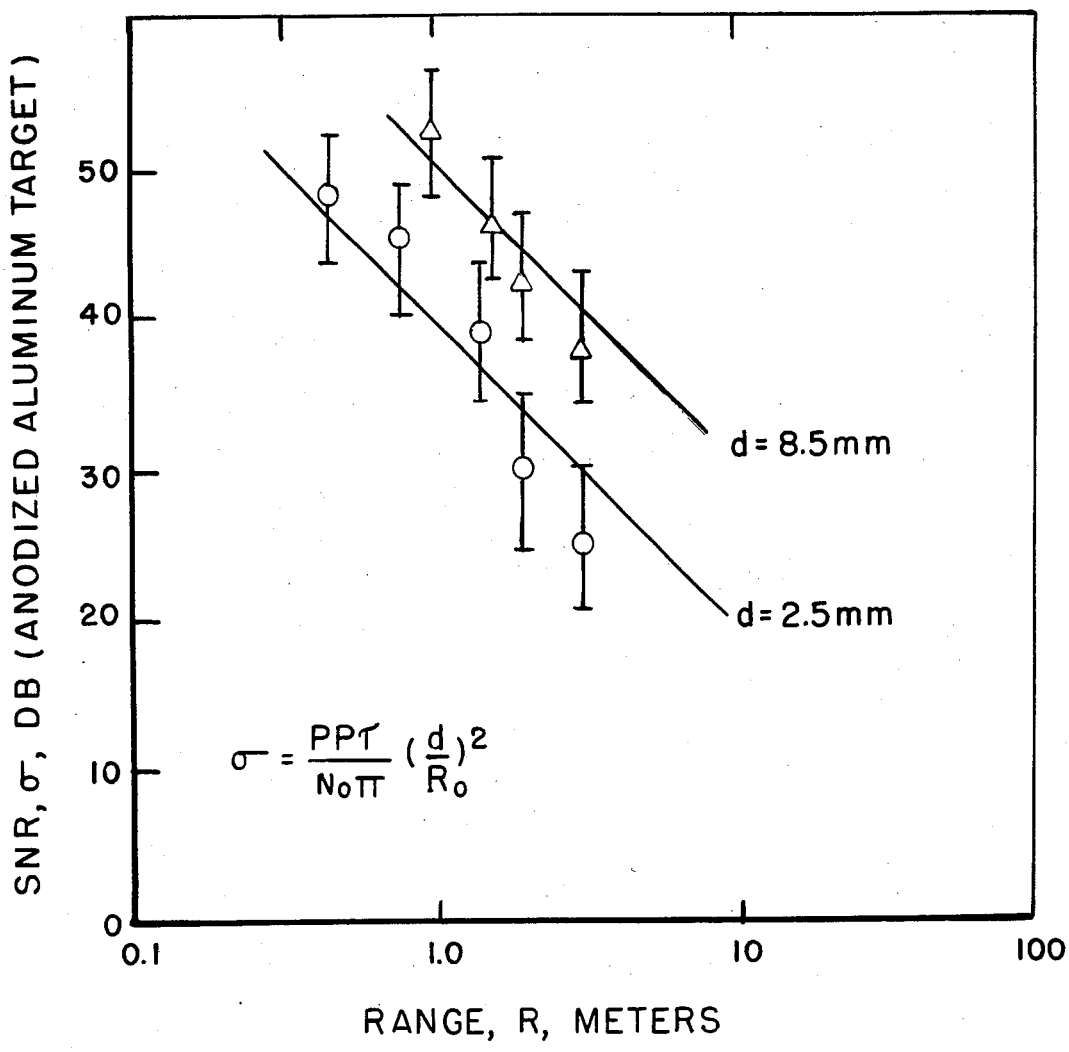
FIG. 5 is a graph depicting signal-to-noise ratio verses range for two beam diameters.
Figure 6:
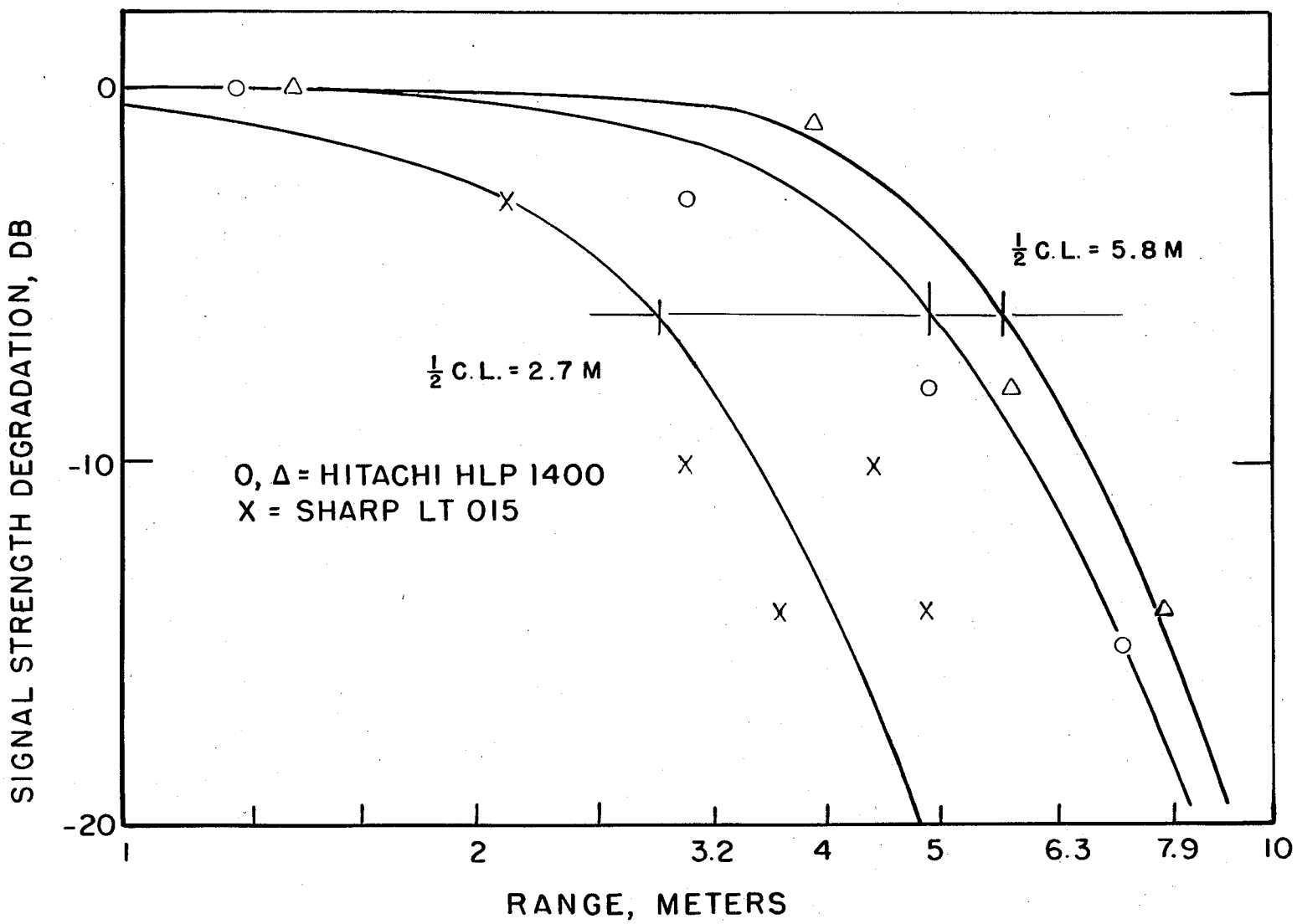
FIG. 6 is a graph depicting signal strength degradation versus range for two laser diodes.
Figure 7:
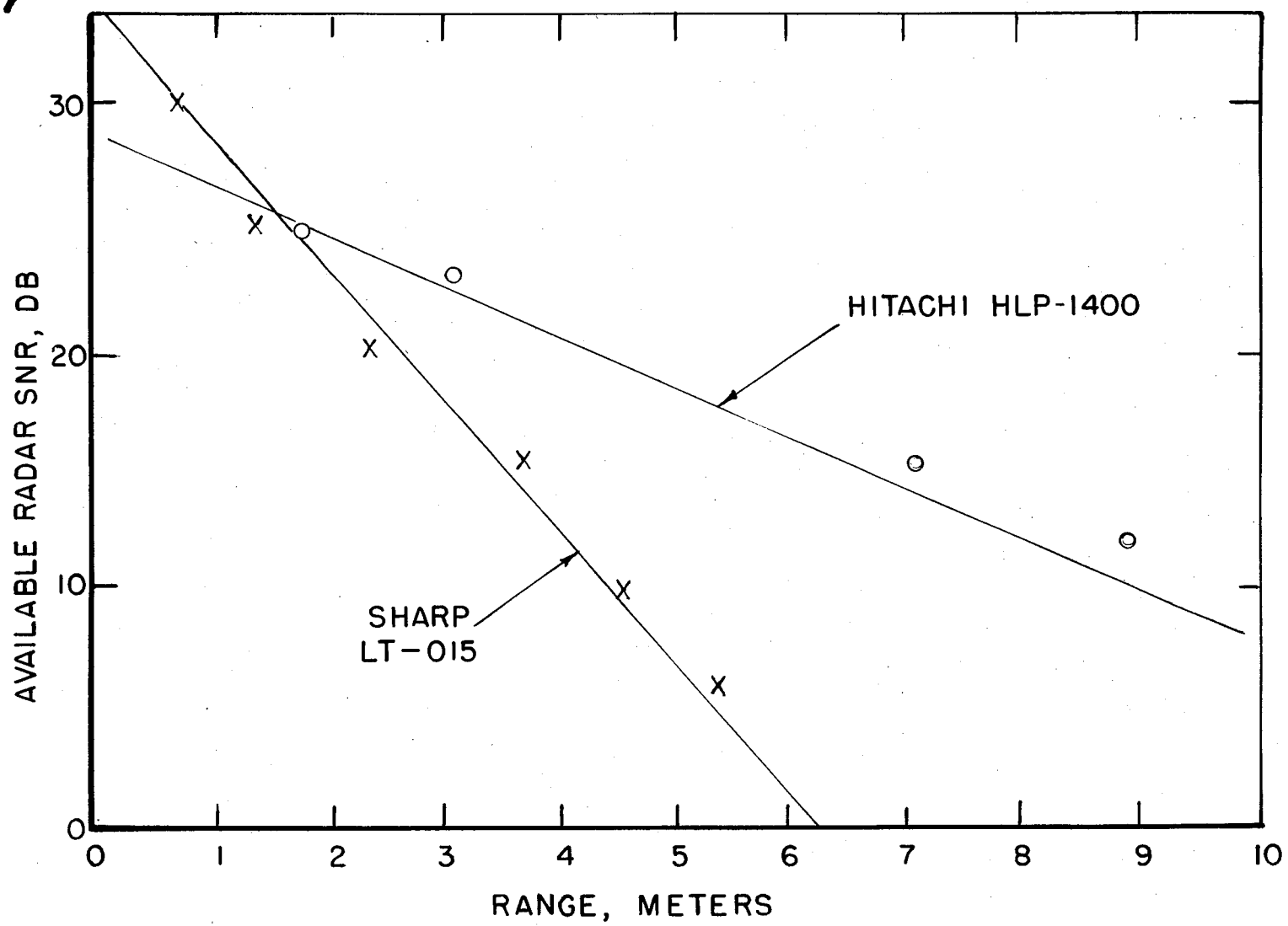
FIG. 7 is a graph depicting available radar SNR versus range for the two laser diodes of FIG. 6.

SNR is plotted as dB in FIG. 5 for two specific cases; the first curve is for beam diameter of 2.5 mm and the second curve is for beam diameter of 8.5 mm. Corresponding experimental data points are plotted for each use. Observation bounds of $\pm 5$ dB are due to the effects of target scintillation or speckle. The good agreement between experiment and the range equation should lead to confidence in the use of the range equation in future system design.

At range values approaching $\frac{1}{2}$ the coherence length, the SNR degrades at a rate greater than predicted from the above equation. The observed (normalized) SNR degrades at a rate predicted by "fringe visibility" observed in classical optics.

Experiments confirming the structure and functions according to the present invention were carried out with Hitachi and Sharp laser diodes. The normalized signal strength degradation as a function of range was plotted. Defining the 6 dB points as $\frac{1}{2}$ the coherence length, it was found that the Hitachi HLP-1400 laser diode had a coherence length of $2\times 5.8$ m=11.6 meters while the Sharp LT015 laser diode measures only $2\times 2.7$ m=5.4 meters. These values of coherence length correspond to linewidths of 26 MHz for the Hitachi and 55 MHz for the Sharp.

The available signal-to-noise ratio as a function of range was plotted where the measured noise is that of the noise pedestal 2 MHz away from the signal peak. Measurements were taken both for the Sharp and Hitachi devices. It was observed that the Hitachi device produced a useful signal-to-noise ratio at a range of 10 meters. Although the Sharp device produced a higher SNR at zero range, the available SNR falls off much more rapidly with range such that the maximum useful range is only 4 meters.

Theory predicts that for any given type of single mode laser device, the coherence length is a direct function of the power output. This theory was experimentally validated using the Hitachi device by reducing the power output while noting the proportional decrease in coherence length. The relationship where the full power of 15 mW gives the laser a 11.6 meter coherence length and reduced power—achieved by reducing the laser current—yields proportionally shorter coherence lengths.

More powerful versions of the Hitachi HLP-1400 are now available. These devices, particularly the HL-8314, are structurally the same as the HLP-1400 but have a rated power output of 30 mW. It is expected that the 30 mW device will have a coherence length greater than 20 meters.

The present invention includes not only proximity detecting devices, but velocity measuring devices as well. The first means is that the signal frequency out of the detector is precisely that produced by the Doppler shift of the light scattered back from the target; the target velocity is thereby determined by measurement of the signal frequency. A second means can be understood by referring specifically to FIG. 3. It can be seen that as the relative velocity between the target and the projectile increases, the signal peaks become sharper. Processor 34 may include means for detecting the sharpness of the signal peak, and thus the velocity between the target and the projectile. The velocity measuring feature is adaptable to both the scanning and non-scanning embodiments described above.

Thus, what has been described is a laser proximity and velocity sensing device capable of extremely compact integration, reliable and rugged construction, yet accurate and precise target discrimination. The use of the laser diode as both the transmitter and receiver ensures perfect spatial mode matching and optical hereodyne mixing. The coherent optical detection of the mixed beam by the PIN detector ensures extremely precise target discrimination even where diffuse targets are present.

While the invention has been described in connection with what is presently considered to be the most practical and preferred embodiments, it is to be understood that this invention is not to be limited to the disclosured embodiments. On the contrary, the present invention is intended to cover various modifications and equivalent arrangements which are included within the spirit and scope of the appended claims. The scope of the appended claims is to be accorded the broadest interpretation so as to encompass all such modifications and equivalent structures.

We claim:

1. In an airborne vehicle having a nose, a proximity detector comprising:

laser diode means having front and rear facets, for generating a main laser signal, and for directing a first portion of said main laser signal out of said front facet as a source beam, and for directing a second portion of said main laser signal out of said rear facet as a local oscillator beam;

first focusing means, coupled to said vehicle nose and having an effective focusing field, for focusing said source beam on a target, and for focusing a return beam reflected from said target into said laser diode means through said front facet;

said laser diode means receiving said return beam and directing it out of said rear facet in optical alignment with said local oscillator beam;

detector means for optical heterodyne detecting said return and local oscillator beams emerging from said rear facet, and for providing a detection signal corresponding to the coherently detected beams; and processing means for receiving the detector means detection signal, and for providing an output signal having a perturbation when said target enters said effective focusing field of said focusing means.

2. Apparatus according to claim 1 further including second focusing means for focusing the return and local oscillator beams emerging from said rear facet onto said detector means.

3. Apparatus according to claim 1 wherein said detector means includes a PIN detector.

4. Apparatus according to claim 1 further including fuse means coupled to said processing means, for activating a munitions fuse upon detection of said output signal perturbation.

5. Apparatus according to claim 1 wherein said laser diode means generates said main laser signal as a continuous wave laser beam having a single spatial mode.

6. Apparatus according to claim 1 further including scanning means, coupled to said vehicle nose, for scanning said source beam to search for said target.

7. Apparatus according to claim 6 wherein said processing means is coupled to said scanner means and includes processing means for (a) determining when said source beam strikes said target, and (b) commanding said scanning means to maintain said source beam on said target.

8. Apparatus according to claim 7 wherein the airborne vehicle has vehicle control apparatus, and wherein said processing means provides a signal to said vehicle control apparatus to cause it to steer said vehicle toward said target.

9. Proximity detecting apparatus, comprising:

laser diode means having first and second emission faces, for generating a main laser signal which emerges from said first and second faces;

first focusing means, having a focal length, for focusing the main laser signal emerging from said first face on a target, and for focusing a return beam reflected from said target in said laser diode means through said first face;

said laser diode means receiving said return beam and aligning it with said main laser signal to form a heterodyned beam, and directing said heterodyned beam out of said second face; and detector means for coherent optical detection of said heterodyned beam, and for providing a detection signal having a perturbation when said target is at a predetermined location on said focal length of said first focusing means.

10. Apparatus according to claim 9 further including second focusing means for focusing said heterodyned beam on said detector means.

11. Apparatus according to claim 10 further including processing means for receiving said detection signal and providing an output signal containing information about a relative distance between said laser diode means and said target.

12. Apparatus according to claim 11 wherein said processing means includes means for providing said output signal with information regarding a relative velocity between said laser diode means and said target.

13. Apparatus according to claim 10 further including scanning means for scanning the focused laser signal.

14. Proximity detecting apparatus, comprising:

laser diode waveguide means having a laser cavity and front and rear faces, for generating a laser signal and directing it from said front and rear faces;

first focusing means having a focal length, for focusing the laser signal emerging from said front face on a target, and for focusing a return light beam reflected from said target into said laser cavity through said front face;

said laser diode waveguide means providing a positive gain to said return beam and guiding it out said rear face in spatial alignment with the laser signal emerging from said rear face as a mixed beam;

second focusing means for focusing said mixed beam;

detector means for coherently optically detecting the focused mixed beam, and for providing a detection signal corresponding thereto; and processing means for receiving said detection signal and providing a first output signal indicative of when said target is within said focal length.

15. Apparatus according to claim 14 wherein said processing means provides a second output signal indicative of a relative velocity between said target and said first focusing means.

16. Apparatus according to claim 14 wherein said laser diode waveguide means provides a frequency modulated laser signal.

17. Apparatus according to claim 14, further including:

scanner means for scanning the focused laser beam to locate said target; and wherein said processor means includes means for halting said scanner means when the scanned beam is incident on said target.

18. Apparatus according to claim 14 further including an airborne vehicle nose for housing said laser diode waveguide means, said first and second focusing means, and said detector means.

19. Apparatus according to claim 18 further comprising fusing means coupled to said processing means, for providing a fusing signal in response to said first output signal.

20. A laser proximity fuse for airborne munitions, comprising laser diode means having a front face and a rear face and a laser cavity, for generating a continuous wave laser beam and directing it out of said front and rear faces;

drive means for driving said laser diode means;

focusing means having a focusing field, for focusing the laser beam on a target, and for focusing a return beam which is the focused laser beam reflected from said target, on said laser diode means front face;

said laser diode means laser cavity (a) receiving the focused return beam, (b) providing a positive gain to said return beam, (c) optically mixing said focused return beam with the laser signal emerging from said rear face to provide a mixed beam, and (d) guiding the mixed beam out of said rear face;

detector means for optical heterodyne detection of said mixed beam, and for providing an output signal indicative of a relative distance between said focusing means and said target.

* * * * *